US008851110B2

(12) United States Patent
Jacobs et al.

(10) Patent No.: US 8,851,110 B2
(45) Date of Patent: Oct. 7, 2014

(54) METHODS AND APPARATUS FOR SPLITTING MULTI-PHASE FLOW

(75) Inventors: Garry E. Jacobs, Aliso Viejo, CA (US); Gerald Zeininger, Long Beach, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 580 days.

(21) Appl. No.: 12/990,694

(22) PCT Filed: May 5, 2009

(86) PCT No.: PCT/US2009/042811

§ 371 (c)(1),
(2), (4) Date: Feb. 22, 2011

(87) PCT Pub. No.: WO2009/137457

PCT Pub. Date: Nov. 12, 2009

(65) Prior Publication Data

US 2011/0186134 A1 Aug. 4, 2011

Related U.S. Application Data

(60) Provisional application No. 61/050,886, filed on May 6, 2008.

(51) Int. Cl.
*F15D 1/00* (2006.01)
*F17D 1/00* (2006.01)

(52) U.S. Cl.
CPC ..... *F17D 1/005* (2013.01)
USPC ..... 137/561 A; 96/216; 96/217; 96/261

(58) Field of Classification Search
USPC ..... 137/561 A; 95/261; 96/216, 217; 55/456; 210/512.1, 787
See application file for complete search history.

(56) References Cited

U.S. PATENT DOCUMENTS

| | | | | |
|---|---|---|---|---|
| 767,721 | A * | 8/1904 | Swartwout | 55/396 |
| 2,084,755 | A * | 6/1937 | Young, Jr. | 137/561 A |
| 2,126,364 | A * | 8/1938 | Witzel | 137/561 A |
| 3,286,992 | A | 11/1966 | Armeniades et al. | |
| 4,068,830 | A | 1/1978 | Gray | |
| 4,111,402 | A | 9/1978 | Barbini | |
| 4,461,579 | A | 7/1984 | McCallum | |
| 4,505,297 | A * | 3/1985 | Leech et al. | 137/561 A |
| 4,516,986 | A | 5/1985 | Jepsen | |
| 4,522,218 | A | 6/1985 | Konak | |
| 4,528,919 | A * | 7/1985 | Harbolt et al. | 137/561 A |
| 4,574,837 | A | 3/1986 | Aggour et al. | |
| 4,593,653 | A * | 6/1986 | Schneider et al. | 137/561 A |

(Continued)

FOREIGN PATENT DOCUMENTS

| | | |
|---|---|---|
| JP | 07012429 | 1/1995 |
| WO | 2004/113788 WO | 12/2004 |
| WO | 2005035995 WO | 4/2005 |

*Primary Examiner* — John Rivell
(74) *Attorney, Agent, or Firm* — Fish & Tsang, LLP

(57) ABSTRACT

A multi-phase fluid is split in a flow splitting device that includes a feed pipe in which a flow redistribution element induces tangential motion in the phases such that the denser phase is forced to redistribute around the periphery of the feed pipe. The so redistributed flow is then split into two or more distribution conduits that are typically perpendicular to the flow direction of the feed flow. Most typically, the feed pipe is in a vertical position.

10 Claims, 4 Drawing Sheets

(56) References Cited

U.S. PATENT DOCUMENTS

| | | | | | |
|---|---|---|---|---|---|
| 4,712,581 | A | * | 12/1987 | Emmenthal et al. | 137/561 A |
| 4,800,921 | A | * | 1/1989 | Greebe | 137/561 A |
| 5,218,985 | A | | 6/1993 | Berger et al. | |
| 5,250,104 | A | | 10/1993 | Berger et al. | |
| 5,415,195 | A | | 5/1995 | Stoy et al. | |
| 5,437,299 | A | * | 8/1995 | Kolpak | 137/561 A |
| 5,551,469 | A | | 9/1996 | Woerheide | |
| 5,670,093 | A | | 9/1997 | Payne | |
| 5,709,468 | A | * | 1/1998 | Woerheide et al. | 137/561 A |
| 5,710,717 | A | | 1/1998 | Hong et al. | |
| 5,810,032 | A | * | 9/1998 | Hong et al. | 137/561 A |
| 6,179,051 | B1 | | 1/2001 | Ayub | |
| 6,997,400 | B1 | * | 2/2006 | Hanna et al. | 239/383 |
| 2005/0000572 | A1 | | 1/2005 | Muller | |

* cited by examiner

METHODS AND APPARATUS FOR SPLITTING MULTI-PHASE FLOW

This application claims priority to U.S. provisional application with the Ser. No. 61/050,886, which was filed May 6, 2008.

FIELD OF THE INVENTION

The field of the invention is splitting a multi-phase flow of two or more phases having different densities into two or more streams of comparable phase composition.

BACKGROUND OF THE INVENTION

There are numerous flow splitting devices known in the art, and in many instances, the particular arrangement for feeding pipes and distribution conduits is not critical. However, where the feed to the flow splitting device is a multi-phase flow, the configuration of the flow splitting device is more significant to achieve comparable (i.e., near-equal) composition of the resulting divided streams.

For example, as described in WO 2004/113788, a phase separating element is provided from which two or more distribution conduits draw the split feed. Alternatively, a weir or sump may be coupled to the feed pipe together with a bypass line to accommodate and obviate maldistribution as described in U.S. Pat. Nos. 5,415,195 and 5,218,985. Similarly, as described in U.S. Pat. No. 5,551,469, orifice plates in the distribution conduits together with bypass lines may be used to accommodate and obviate maldistribution. In still further known devices and methods, a pre-separator vane and respective nozzles in the distribution conduits can be implemented to increase homogenous distribution of the phases as described in U.S. Pat. No. 5,810,032. Specific pipe arrangements with control valves as shown in U.S. Pat. No. 4,522,218 may also be employed.

While such known devices and methods typically provide at least some advantages in splitting two-phase flows, several drawbacks nevertheless exist, especially where the two phase flow comprises two or more phases with considerable difference in density. Thus, there is still a need for improved devices and methods to split flow of materials having different densities into two or more streams of comparable phase composition.

SUMMARY OF THE INVENTION

The present invention is directed to devices and methods of splitting a multi-phase flow that comprises at least two phases with different density, and which optionally may be immiscible with each other. Flow splitting is preferably preceded by radial redistribution of the phases with different densities using a redistribution element that induce tangential motion into the phases. It should be noted that the term "fluid" as used herein refers to all materials that flow, and as such includes gases, liquids, and solids, and all combinations thereof. Thus, for example, a multi-phase fluid may be composed of two liquids having different densities, a liquid and a gas, or a liquid in which solid particles are entrained.

In one aspect of the inventive subject matter a flow dividing device for a mixed phase fluid (e.g., comprising at least two components having different densities, with at least one of the components being a fluid) includes a feed conduit having a feed end and a discharge that has a plurality of distribution conduits fluidly coupled to the discharge end in a splitter arrangement wherein the distribution conduits are arranged symmetrical with respect to the axis of the inlet conduit. A flow redistribution element is fluidly coupled to the feed conduit and configured to induce tangential momentum to the mixed phase to thereby preferentially force at least some of the higher density component to the inner wall of the feed conduit. It should be noted that tangential momentum in a fluid will induce a swirl motion or rotational motion in the fluid and that the terms "swirl motion" and "rotational motion" are used interchangeably herein.

Particularly contemplated flow redistribution elements are configured as one or more static mixers, and/or to induce swirl (rotational motion) in the mixed phase fluid. Therefore, at least some of the redistribution elements include one or more curved (e.g., helical) elements. It is further generally preferred that the redistribution element is disposed within the feed pipe between the feed end and the discharge end (that most typically includes two or more distribution conduits), and that the flow dividing device further includes an impacting symmetrical fitting (e.g., tee or wye fitting for bifurcation) as the flow splitting element.

Therefore, a method of dividing flow of a mixed phase fluid will include a step of feeding the mixed phase fluid into a feed conduit, wherein the mixed phase fluid includes a first component having a first density and a second component having a density greater than the first density, and a further step of inducing tangential momentum to the mixed phase to thereby preferentially force at least some of the higher density component to an inner wall of the feed conduit. In yet another step, the mixed phase is split into two or more portions at a location downstream of the flow redistribution element. With respect to the flow redistribution and splitting elements, the same considerations as provided above apply.

Various objects, features, aspects and advantages of the present invention will become more apparent from the following detailed description of preferred embodiments of the invention, along with the accompanying drawing.

DETAILED DESCRIPTION

Figures 1A, 1B, 1C:
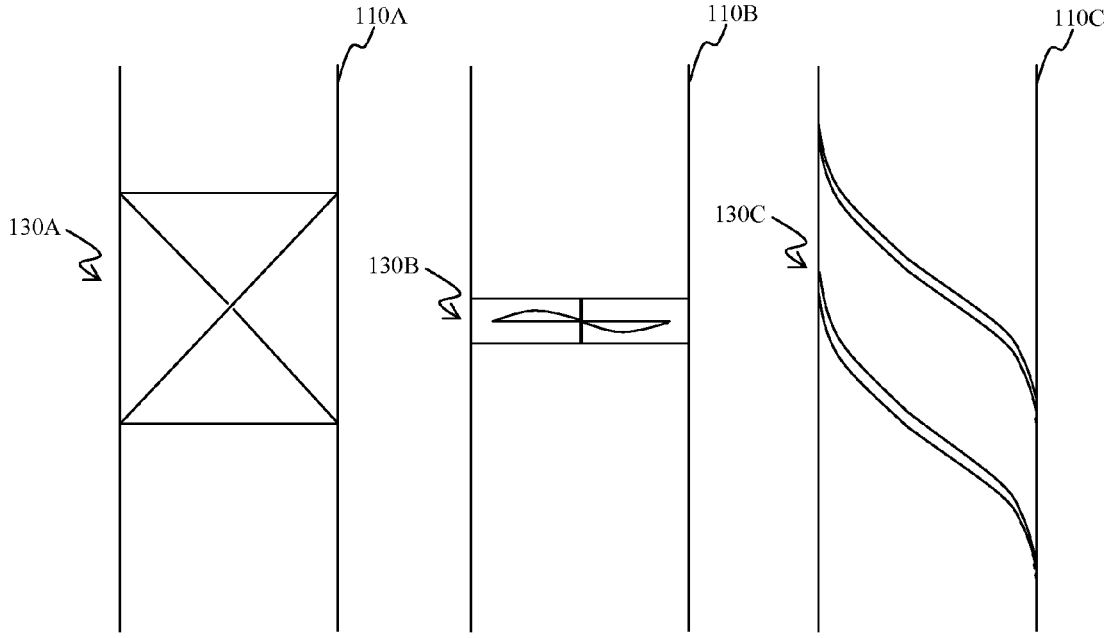
FIGS. 1A-1C depict exemplary configurations of flow redistribution elements.

The inventors have discovered that a multi-phase flow can be split into two or more streams with substantially same phase distribution as compared to the multi-phase flow using one or more flow redistribution elements positioned upstream of two or more distribution conduits, wherein the redistribution element (typically disposed within the lumen of the feed conduit) imparts a tangential momentum to the mixed phase to preferentially force at least some of the second component to an inner wall of the feed conduit. The term "substantially same phase distribution" as used herein in refers to a difference in phase content of no more than 10%, and more typically no more than 5%. For example, where a multi-phase flow is bifurcated and has a first component at 60 wt % and a second component at 40 wt %, streams derived downstream of the redistribution element in the distribution conduits are said to have substantially the same phase distribution if one of the derived streams has the first component at 56 wt % and the second component at 44 wt %. In this example, the other derived stream has the first component at 64% and the second component at 36%.

Contemplated devices and methods are especially suitable for splitting of multi-phase streams in which all or most of the phases are essentially immiscible (i.e., will form a distinct interface between the phases and have dissimilar densities (e.g., at least 10% and more typically at least 25% difference). For example, first and second phases may be a hydrocarbon stream and a non-hydrocarbon (e.g., water) stream, or a liquid water stream and a water vapor stream. In most typical aspects of the inventive subject matter, contemplated devices have a vertical pipe, and in a downstream position, a symmetrical multi-branch splitter (e.g., an impacting tee or wye) with two or more distribution conduits fluidly coupled to the vertical pipe, wherein the flow redistribution element comprises one or more flow-redirecting vanes and wherein the flow redistribution element is located upstream of the splitter. While the term "impacting tee" is used in the remainder of this disclosure to refer to a splitter with two outlets, all symmetrical multi-branch splitters as further discussed below are contemplated. The term "vertical" used herein refers to a direction that is perpendicular to the plane of the horizon with a deviation of no more than 20 degrees. Most typically, this will be a direction that is parallel to the earth's gravitational force.

It should be especially appreciated that preferred devices and methods do not require a phase separation vessel, weir, or other structure external to the conduits as one or more flow-redirecting elements (e.g., vanes) are preferably located within the vertical pipe or coupled to the inside wall of the pipe in a position upstream of the impacting tee at which the two-phase (or higher-phase) split occurs. The flow-redirecting elements condition the multi-phase flow prior to entering the splitter by inducing tangential flow (e.g., swirling motion) within the pipe as the tangential flow causes the denser phase to redistribute about the periphery of the pipe. Therefore, it should be recognized that the redistribution of the denser phase about the periphery of the inlet pipe promotes symmetry to the flow of each phase relative to the outlet conduits, which in turn promotes a uniform distribution of each phase into each of the outlet conduits.

Viewed from a different perspective, and in contrast to static mixing devices that intimately intermingle two phases, it should be recognized that the phase redistribution contemplated herein promotes a substantially uniform but separate distribution of the two phases towards the downstream splitter, which in turn allows for a nearly uniform distribution of the two (or more) phases to each of the distribution conduits (i.e., substantially same phase distribution in each of the distribution conduits) emanating from the splitter. Such configuration advantageously eliminates the need for a separate phase separation vessel and bypass conduits. In contrast, most of the heretofore known devices and methods utilize various specific piping and fitting arrangements with the objective of promoting relatively uniform splitting of two-phase vapor/liquid flow (e.g., FIG. 1 in WO 2004/113788). Alternatively, parallel trains of equipment need to be installed to avoid splitting two-phase flow (e.g., FIG. 4 in WO 2004/113788).

It should still further be appreciated that contemplated configurations and methods may also help avoid the need for parallel equipment trains via use of a vertical impacting tee with two or more distribution conduits, thus reducing the capital cost of processing facilities. In this manner, the two-phase flow in a single pipe can be nearly uniformly distributed to two or more distribution conduits. Consequently, devices and methods contemplated herein are especially desirable in the design and operation of commercial processing facilities where phase maldistribution detrimentally impacts equipment performance and/or capacity. For example, the devices and methods presented herein may be advantageously employed in distribution of two-phase flow to multi-pass fired heaters, multi-bay air coolers, large diameter distillation columns, and other equipment utilizing parallel flow paths as is commonly found in various refinery processing units, including crude units, vacuum units, reformers, hydrotreaters, and hydrocrackers.

With respect to suitable flow redistribution elements it is contemplated that all structures, configurations, and devices are deemed appropriate so long as such structures, configurations, and devices will impart a tangential momentum to the mixed phase to thereby preferentially force at least some of the second component to an inner wall of the feed conduit. Therefore, suitable flow redistribution elements will include one or more vanes, spiral elements (typically coaxially arranged within the feed conduit), jets, or nozzles that will impart tangential momentum to the mixed phase flow in the feed conduit.

However, it is especially preferred that a flow redistribution element is a static mixer in which one or more vanes or blades impart the tangential momentum to the mixed phase. For example, suitable redistribution element geometries are found in static mixers as taught in U.S. Pat. No. 4,068,830 (described for use in laminar mixing/blending of viscous fluids), U.S. Pat. No. 4,111,402 (using spiral axis), U.S. Pat. No. 4,461,579 (using isosceles triangular base plates and vanes), and U.S. Pat. No. 3,286,992 (plurality of curved elements). With respect to the position of the flow redistribution element(s) it should be recognized that the element(s) will be generally positioned upstream of the splitter, and the particular nature of the device will determine at least to some degree the position relative to the feed conduit. However, it is generally preferred that the flow redistribution element(s) be located within the lumen of the feed conduit to save space.

Further contemplated redistribution elements will include those in which one or more vanes or other structures are in a fixed position within the lumen of the feed conduit, and wherein the vanes or other structures may be static or moving. For example, static vanes may be coupled to the inside of the feed conduit, and/or be formed as ridges or rifling on the inside surface of the feed conduit. Similarly, one or more blades may be disposed within the feed conduit, or a cone with vanes or rifling may be disposed in the lumen of the feed conduit. Alternatively, one or more moving, and especially rotating structures may be included (that are preferably in a fixed position relative to the conduit). For example, suitable moving structures include one or more rotating propellers that may be actively driven by a motor or other force, or that may be passively driven by the force of the multi-phase flow. Similarly, one or more rotating cones (preferably comprising one or more vanes or rifling) may be disposed in the lumen of the conduit to impart tangential momentum to the multi-phase fluid.

Regardless of the particular configuration of the redistribution element(s), it is also noted that while the configuration of the redistribution elements is preferably fixed, adjustable configurations are also deemed suitable to adjust to different flow rates and/or compositions. For example, where the redistribution element comprises a vane, spiral blade, or rifling the vane, blade, or rifling angle (typically expressed as number of full turns per length unit) may be adjustable. Similarly, where the redistribution element comprises a propeller, the propeller blade angle may be adjustable. FIGS. 1A-1C depict various exemplary configurations of flow redistribution elements. Here, redistribution element 130A is configured as a non-moving spiral blade that is fixedly coupled to the inside of feed conduit 110A, while the redistribution element 130B is configured as rotating propeller blade that is coupled (via a propeller cage) to the inside of feed conduit 110B. In yet another configuration, redistribution element 130C is configured as non-moving helically arranged rifling that is fixedly coupled to the inside of feed conduit 110C. In these examples, the conduits are preferably vertically oriented (parallel to the earth's gravitational force) with the flow entering at a position below the redistribution element and with the redistributed flow impacting a flow dividing structure (not shown) at a position above the redistribution element.

Figure 2A:
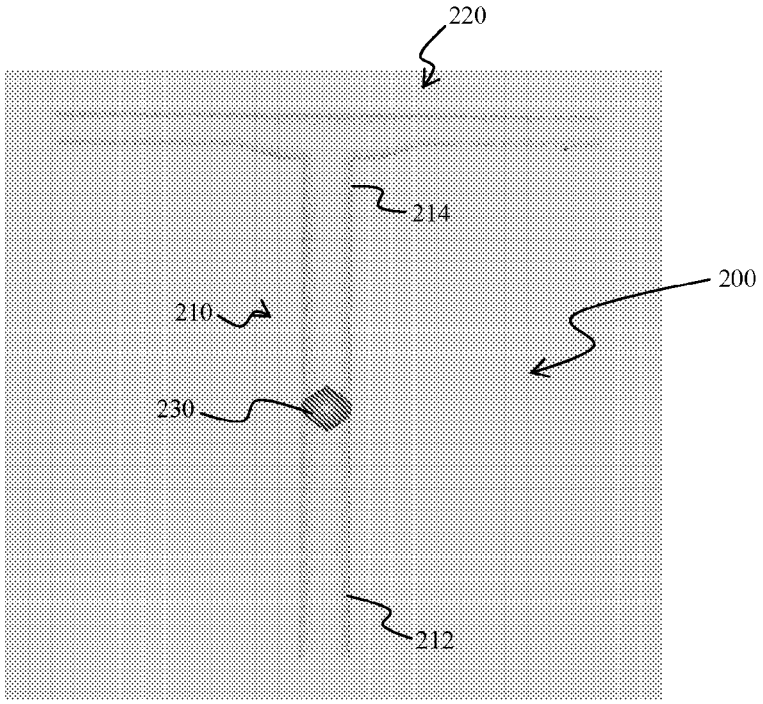
FIG. 2A depicts a first exemplary flow splitting device in a feed conduit upstream of two distribution conduits.
Figure 2B:
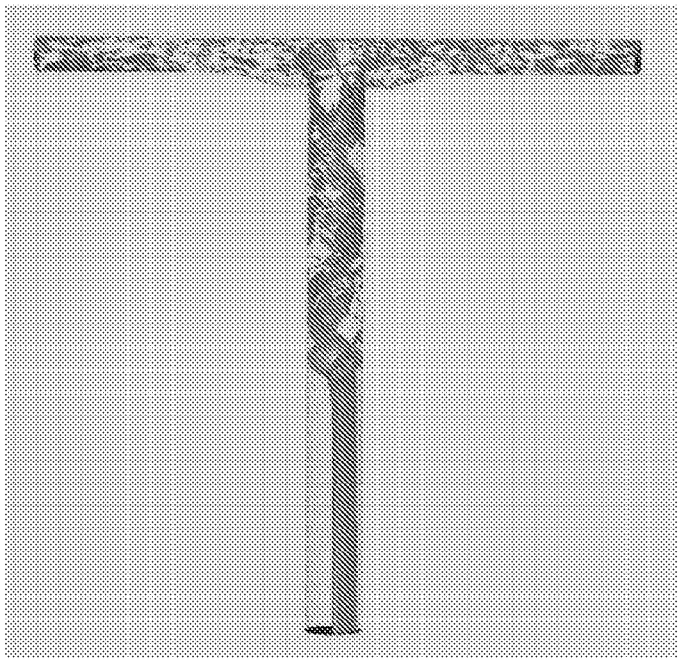
FIG. 2B depicts simulated flow of a two-phase fluid in the device of FIG. 2A.

It is generally preferred that the flow redistribution element is configured such that the second, higher density component is forced onto a majority (e.g., at least 50%, more typically at least 70%, and most typically at least 90%) of the inner wall of the feed conduit. FIG. 2A exemplarily depicts a swirl vane in which the leading edge of blade is perpendicular to the split (a tee), and FIG. 2B shows a calculated distribution of the two phases in the feed conduit and distribution conduits. With further reference to FIG. 2A, the flow dividing device 200 includes a feed conduit 210 to which an impacting tee 220 with two distribution conduits is fluidly coupled to the discharge end 214 of feed conduit 210. Disposed between the feed end 212 and the discharge end 214 is flow redistribution element 230 that is configured as a helical blade where the leading blade edge is perpendicular to the longitudinal axes of the distribution conduits. In the calculations used for the Figures presented herein, a non-uniform distribution of the two phases upstream of the flow redistribution element was assumed (here: denser phase biased against one side of the wall).

Figure 3A:
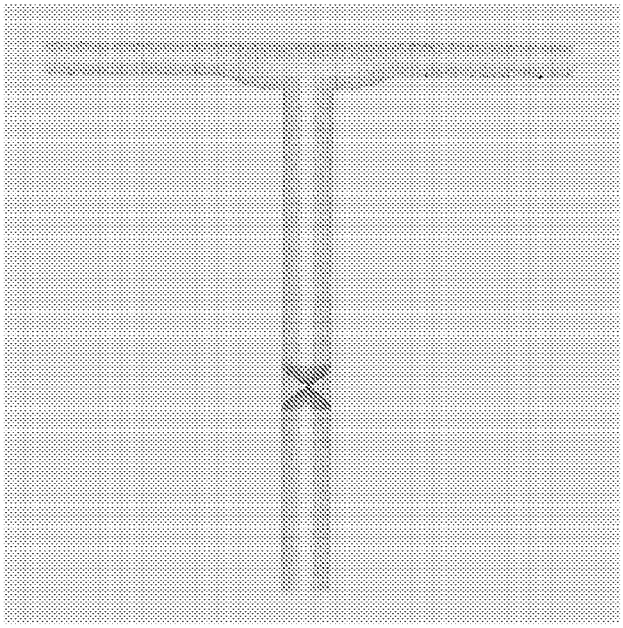
FIG. 3A depicts a second exemplary flow splitting device in a feed conduit upstream of two distribution conduits.
Figure 3B:
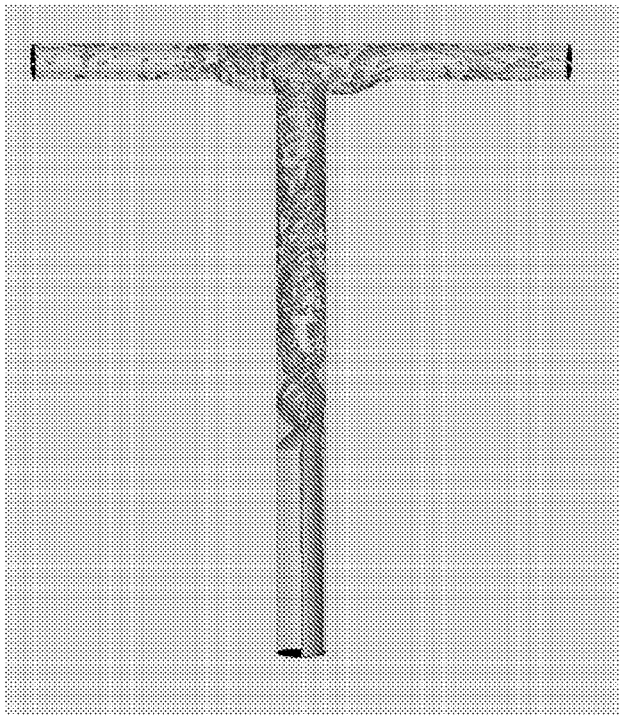
FIG. 3B depicts simulated flow of a two-phase fluid in the device of FIG. 3A.
Figure 4A:
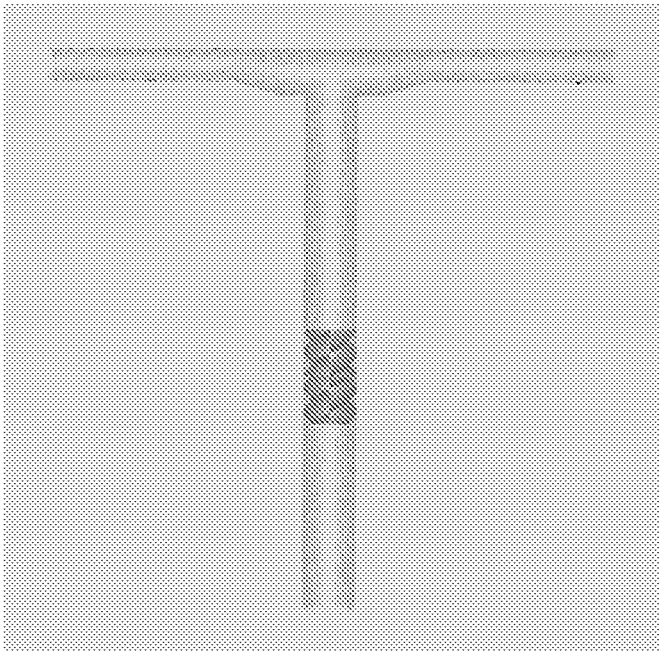
FIG. 4A depicts a second exemplary flow splitting device in a feed conduit upstream of two distribution conduits.
Figure 4B:
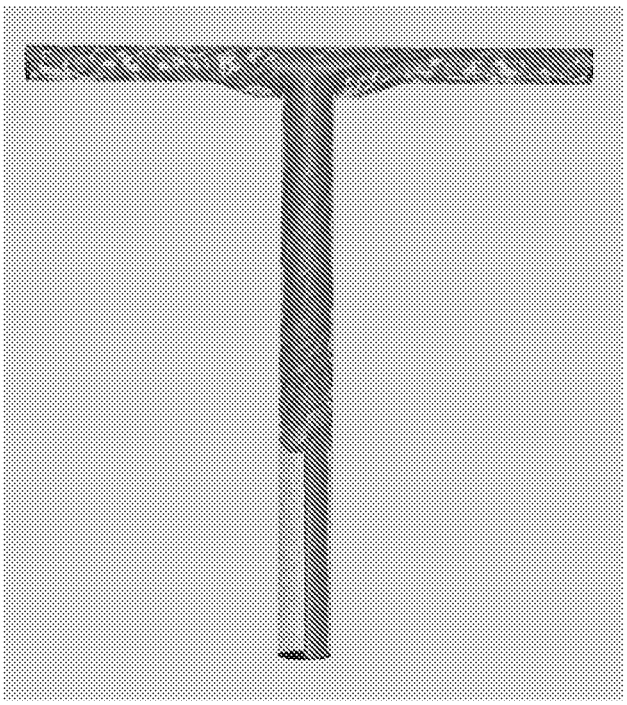
FIG. 4B depicts simulated flow of a two-phase fluid in the device of FIG. 4A.

Similarly, FIG. 3A exemplarily depicts a swirl vane in which the leading edge of blade is parallel to the longitudinal axes of the distribution conduits (here: configured as an impacting tee), and FIG. 3B shows a calculated distribution of the two phases in the feed conduit and distribution conduits. FIG. 4A exemplarily depicts two serially disposed stages of a dual swirl vane with leading edges parallel and perpendicular to the longitudinal axes of the distribution conduits, and FIG. 4B shows a calculated distribution of the two phases in the feed conduit and distribution conduits. As is readily apparent, all configurations provide significant redistributions, and more intense partitioning of the two phases in the feed conduit using multiple stages and/or multiple vanes per stage will provide a more significant redistribution of the second, higher density component onto the inner wall of the feed conduit. In the shown exemplary calculations, the denser phase in FIG. 4B is forced almost entirely against the inner wall of the feed conduit and thus promotes a more uniform distribution of the feed into the distributing conduits.

It is especially preferred that the splitter element may comprise a simple impacting tee when two conduits are desired. An impacting tee with multiple branches is preferred when more than two outlet conduits are present. Another preferred configuration uses splitters with outlet conduits that are not perpendicular to the inlet conduit, such as wye splitters when two outlet conduits are desired. Analogously, three outlet conduits can be achieved with a symmetrically trifurcated splitter, four outlets with a symmetrically quadfurcated splitter, etc. In all cases, the splitter is most preferably configured with the outlet conduits symmetrical about the centerline of the inlet conduit when viewed along the axis of the inlet conduit. Consequently, it should be appreciated that in preferred aspects of the inventive subject matter the outlet conduits are arranged in a rotational symmetry with respect to a longitudinal axis of the feed conduit.

Thus, specific embodiments and applications for splitting multi-phase flows have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A flow dividing device for a multi-phase fluid that comprises a first component having a first density and a second component having a second density that is greater than the first density, the dividing device comprising:

a feed conduit having a uniform diameter between a feed end and a discharge end with a plurality of distribution conduits fluidly coupled to the discharge end;

wherein the distribution conduits are arranged symmetrically with respect to a longitudinal axis of the feed conduit, and wherein the feed conduit is substantially vertically oriented and coupled to the distribution conduits, and further wherein an upstream section of the distribution conduits is coaxial with the feed conduit so as to form an impacting tee or impacting wye;

a flow redistribution element fluidly coupled to or integrally formed from the feed conduit in a position upstream of the discharge conduit and configured to induce tangential momentum along the longitudinal axis of the feed conduit to the multi-phase fluid to thereby preferentially force at least some of the second component to an inner wall of the feed conduit and to thereby produce a substantially equal phase distribution into the distribution conduits via rotational motion of the multi-phase fluid; and wherein the flow redistribution element comprises at least two helically shaped vanes with at least one helical turn of the vane.

2. The flow dividing device of claim 1 wherein the distribution conduits are perpendicularly arranged with respect to the longitudinal axis of the feed conduit.

3. The flow dividing device of claim 1 comprising at least two distribution conduits.

4. The flow dividing device of claim 1 wherein the distribution conduits are configured as an impacting tee.

5. The flow dividing device of claim 1 comprising at least two serially coupled flow redistribution elements.

6. A method of dividing a multi-phase fluid, the method comprising:

feeding the multi-phase fluid into a feed conduit having a uniform diameter and that is substantially vertically oriented, wherein the multi-phase fluid includes a first component having a first density and a second component having a second density that is greater than the first density; and inducing tangential momentum along a longitudinal axis of the feed conduit to the multi-phase fluid with a flow redistribution element that comprises at least two helically shaped vanes to thereby preferentially force at least some of the second component to an inner wall of the feed conduit;

symmetrically splitting the multi-phase fluid into at least two portions at a position downstream of the flow redistribution element;

wherein the step of splitting is performed using at least two distribution conduits that are arranged symmetrically with respect to the longitudinal axis of the feed conduit to thereby form an impacting tee or an impacting wye; and wherein the tangential momentum is effective to effect a substantially equal phase distribution into the distribution conduits via rotational motion of the multi-phase fluid.

7. The method of claim 6 wherein the at least two distribution conduits are perpendicularly arranged with respect to the longitudinal axis of the feed conduit.

8. The method of claim 6 wherein the flow redistribution element is disposed within the feed conduit between the feed end and the discharge end.

9. A method of splitting a multi-phase fluid into a plurality of streams having substantially same phase distribution, comprising a first step of separating within a substantially vertically oriented feed conduit having uniform diameter at least two phases according to their density using centripetal force induced by a flow redistribution element that comprises at least two helically shaped vanes, and a further step of dividing the two phases into the plurality of streams using a plurality of distribution conduits, wherein the feed conduit and the distribution conduits are configured as an impacting tee or an impacting wye, and wherein the centripetal force is effective to produce a substantially equal phase distribution into the distribution conduits via rotational motion of the multi-phase fluid along a longitudinal axis of the feed conduit.

10. The method of claim 9 wherein the multi-phase fluid comprises water liquid and water steam, a hydrocarbon component and an aqueous component, or two hydrocarbon components.

* * * * *